US011236896B1

(12) United States Patent
Schiel

(10) Patent No.: US 11,236,896 B1
(45) Date of Patent: Feb. 1, 2022

(54) CLOSED-DOOR NIGHT LIGHT

(71) Applicant: Casey Schiel, North Platte, NE (US)

(72) Inventor: Casey Schiel, North Platte, NE (US)

( * ) Notice: Subject to any disclaimer, the term of this patent is extended or adjusted under 35 U.S.C. 154(b) by 0 days.

(21) Appl. No.: 17/030,235

(22) Filed: Sep. 23, 2020

(51) Int. Cl.

| | |
|---|---|
| ***F21V 23/04*** | (2006.01) |
| ***F21V 21/08*** | (2006.01) |
| ***F21V 23/00*** | (2015.01) |
| ***F21S 9/02*** | (2006.01) |
| ***F21V 33/00*** | (2006.01) |
| ***F21V 21/096*** | (2006.01) |
| ***F21W 131/30*** | (2006.01) |
| ***F21Y 115/10*** | (2016.01) |
| ***F21Y 103/10*** | (2016.01) |

(52) U.S. Cl.
CPC ..... *F21V 23/0471* (2013.01); *F21S 9/02* (2013.01); *F21V 21/0808* (2013.01); *F21V 21/096* (2013.01); *F21V 23/003* (2013.01); *F21V 23/0464* (2013.01); *F21V 23/0492* (2013.01); *F21V 33/0056* (2013.01); *F21W 2131/30* (2013.01); *F21Y 2103/10* (2016.08); *F21Y 2115/10* (2016.08)

(58) Field of Classification Search
CPC ..... F21V 23/003; F21V 23/0464; F21V 23/0471; F21V 23/0492; F21V 21/0808; F21V 21/096; F21V 33/0056; F21S 9/02
See application file for complete search history.

(56) References Cited

U.S. PATENT DOCUMENTS

| | | | | |
|---|---|---|---|---|
| 4,872,095 | A | 10/1989 | Dubak et al. | |
| 5,892,331 | A * | 4/1999 | Hollaway | H05B 39/081 315/159 |
| 6,729,740 | B1 | 5/2004 | Gazard | |
| 7,165,864 | B2 | 1/2007 | Miller | |
| 7,321,301 | B2 | 1/2008 | Spoltore et al. | |
| 9,200,771 | B2 | 12/2015 | Brennan | |
| 9,273,859 | B2 | 3/2016 | Smith | |
| 10,203,084 | B1 * | 2/2019 | Huang | F21V 23/0471 |
| 10,371,330 | B2 | 8/2019 | Chien | |

(Continued)

OTHER PUBLICATIONS

Aliexpress, Mini Automatic Magnetic Sensor Sensitive Wireless LED Light Cabinet Door Lamp, https://www.aliexpress.com/item/32804708782.html, Print Date Sep. 23, 2020, 8 pages.

*Primary Examiner* — Alan B Cariaso
(74) *Attorney, Agent, or Firm* — Suiter Swantz pc llo

(57) ABSTRACT

A lighting apparatus fixable to a door is disclosed. The lighting apparatus includes an illumination assembly. The illumination assembly includes a light element, a door position sensor, and a control circuit electrically coupled to the lighting element. The control circuit is configured to control an ON/OFF state of the lighting element based on one or more signals from the door position sensor. In some embodiments, the illumination assembly further includes a housing configured to house the lighting element. The housing is further configured to me mechanically attachable to the door. The control circuit may be further configured to switch from an OFF state to an ON state when the door is moved to a closed position. The control circuit may be further configured to switch the lighting element from an ON state to an OFF state when the door is moved to an open position.

22 Claims, 11 Drawing Sheets

(56) References Cited

U.S. PATENT DOCUMENTS

| | | | | |
|---|---|---|---|---|
| 2007/0241259 | A1* | 10/2007 | Pandorf | F21V 23/0442 250/214 AL |
| 2010/0315008 | A1* | 12/2010 | Williamson | F21S 9/032 315/152 |
| 2011/0075430 | A1* | 3/2011 | Albert | F21V 15/01 362/362 |
| 2014/0184069 | A1* | 7/2014 | Hollaway | F21S 9/02 315/84 |
| 2015/0285489 | A1* | 10/2015 | Ulysse | F21V 33/006 362/183 |
| 2016/0369998 | A1* | 12/2016 | Ellis | F21V 33/006 |
| 2017/0236389 | A1* | 8/2017 | Tang | B60Q 3/217 49/13 |
| 2018/0227654 | A1* | 8/2018 | Majkowski | B60Q 3/82 |

* cited by examiner

CLOSED-DOOR NIGHT LIGHT

TECHNICAL FIELD

The present invention generally relates to a lighting device, and, more particularly, to a nightlight with safety features.

BACKGROUND

Fire safety and prevention is an important issue for many families. Keeping doors closed in a home reduces the speed that a fire may spread throughout the home, and prevents fire, smoke and dangerous gases from entering rooms. Many people, particularly children, prefer to have a bedroom door open at night so that light outside the bedroom, such as a hallway light, may partially illuminate the bedroom. Nightlights allow partial or low illumination of a bedroom which would allow a child to close the door while still having the security of a light. However, a child having a nightlight in their bedroom may still intentionally or unintentionally keep their bedroom door open at night, potentially leading to injury or death if a fire were to start in the home. Thus, it is desirable to provide a method and product that avoids the shortcomings of conventional approaches.

SUMMARY

A lighting apparatus fixable to a door is disclosed. In some embodiments, the lighting apparatus comprises an illumination assembly. In some embodiments, the illumination assembly includes a lighting element. In some embodiments, the illumination assembly further includes a door position sensor. In some embodiments, the illumination assembly further includes a control circuit electrically coupled to the lighting element. In some embodiments, the control circuit is configured to control an ON/OFF state of the lighting element based on one or more signals from the door position sensor. In some embodiments, the illumination assembly further includes a housing configured to house the lighting element and the control circuit. In some embodiments, the housing is further configured to be mechanically attachable to the door.

A method is also disclosed. In some embodiments, the method includes sensing, with a door position sensor, a position of a door. In some embodiments, the method further includes controlling an ON/OFF state of a light element attached to the door based on the position of the door.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DETAILED DESCRIPTION

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Accordingly, embodiments of the present disclosure are directed to a nightlight and a method of operation for a nightlight that is attached to a door, wherein the nightlight is configured to illuminate when the door is closed and not illuminate when the door is opened. By way of example, a nightlight that lights up when the bedroom door is closed and turns off when the door is open will encourage the user, particularly a child, to keep the bedroom door closed during the night, decreasing the risk of a fire spreading into the bedroom during a fire emergency.

Figure 1:
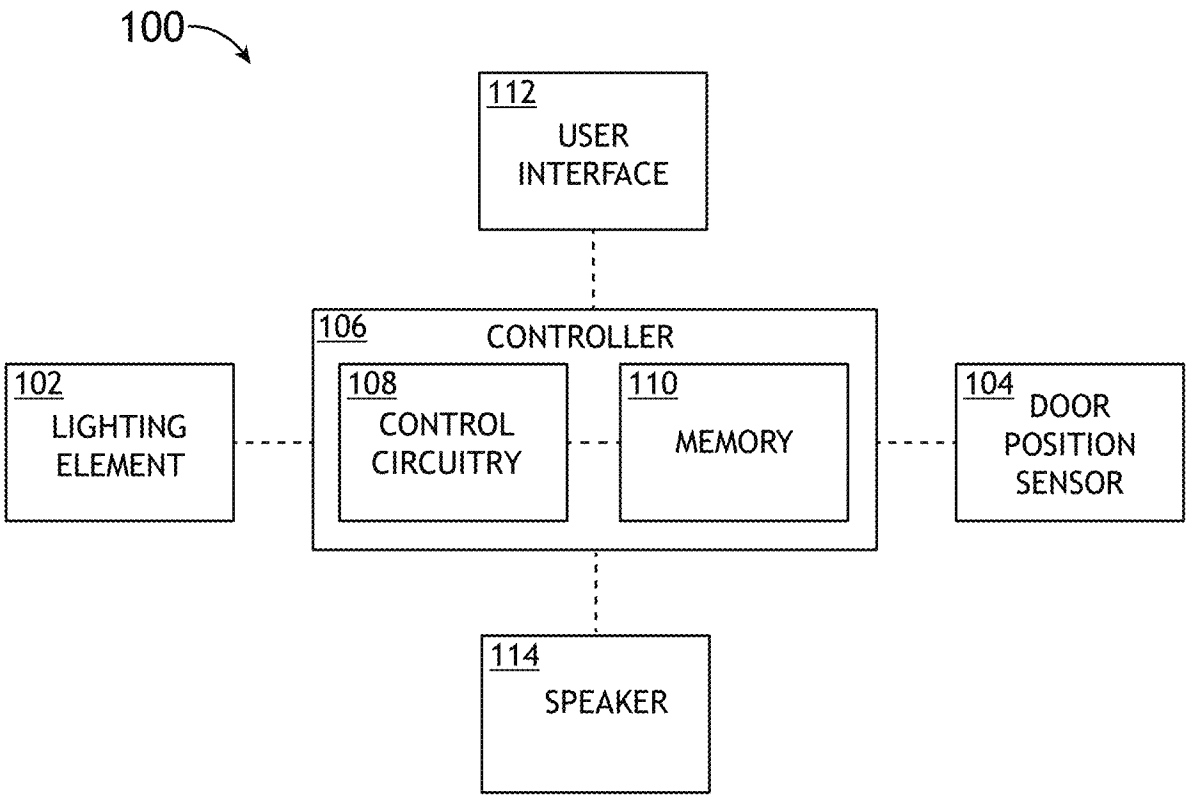
FIG. 1 is a diagram illustrating a lighting apparatus affixed to a door, in accordance with one or more embodiments of the present disclosure.

FIG. 1 illustrates a lighting apparatus 100 fixable to a door, in accordance with one or more embodiments of the present disclosure. In particular, FIG. 1 illustrates a lighting apparatus 100 that can detect the position of a door and emit light based on the position of the door and/or input from a user. The lighting apparatus 100 includes one or more light elements 102 and a door position sensor 104. The system 100 may additionally include, but is not limited to, a controller 106 and a user interface 112. The controller 106 includes control circuitry 108 and a memory 110. The user interface 112 includes one or more input devices (e.g., knobs, switches or toggles) that allows a user to change one or more settings on the lighting apparatus 100. The user interface 112 may also include a microphone. For example, the user interface 112 may include a microphone that accepts voice commands. In another example, the user interface 112 may include a microphone that accept input from other alarm systems (e.g., smoke alarms or intruder alarms).

In some embodiments, the controller 106 is communicatively coupled to the one or more light elements 102. In this regard, the control circuitry 108 of the controller 106 may be configured to generate one or more control signals configured to adjust one or more characteristics of the one or more light elements 102. For example, the controller 106 may be configured to generate and send a signal to the light element 102 to emit light with a specific characteristic (e.g., wavelength, intensity, or strobe-effect).

In some embodiments, the controller 106 is communicatively coupled to the door position sensor 104. In this regard, the control circuitry 108 of the controller 106 may be configured to receive input from the door position sensor 104 and generate one or control signals to adjust one or more characteristics of the one or more light elements 102 based on the input, For example, the controller 106 may receive input from the door position sensor 104 that the door is in the closed position, then generate and send a signal to the light element 102, to emit light.

In some embodiments, the controller is communicatively coupled to the user interface 112. In this regard, the control circuitry 108 of the controller 106 may be configured to: receive input from the user interface and or door position sensor 104 and generate one or more control signals based on the input to adjust one or more characteristics of the one or more light elements 102. For example, the controller 106 may receive an input from the user interface 112 instructing the lighting apparatus 100 to activate the lighting element 102 for 15 minutes after the door position sensor 104 detects that the door is closed. After receiving a signal from the door position sensor 104 that the door is closed, the controller may then generate and send a control signal to the lighting apparatus 100 instructing the lighting apparatus to activate for 15 minutes.

In some embodiments, the lighting apparatus further includes a speaker 114 communicatively coupled to the controller 106. The speaker 114 may be configured to emit an alarm sound and/or soothing sound. For example, the speaker 114 may be configured to emit an alarm sound if the lighting apparatus 100 has detected smoke or carbon monoxide in the room. In another example, the speaker 114 may be configured to emit an alarm sound if the door has been opened after the lighting element 102 has been activated. For instance, once the door has been closed and the lighting element 102 is turned on, the speaker 114 may emit an alarm sound once the door has been opened. In another example, the speaker 114 may be configured to emit a soothing sound to encourage the occupant in the room to fall asleep. For instance, once the door has been closed and the lighting element 102 is turned on, the speaker may play a lullaby or other soothing sounds, such as ocean waves. The speaker may be configured to emit the soothing sounds continuously or for a set amount of time. The speaker 114 may also be configured to operate in conjunction with the lighting element 102. For example, the speaker 114 may play a lullaby for as long as the lighting element is alight.

Figure 2A:
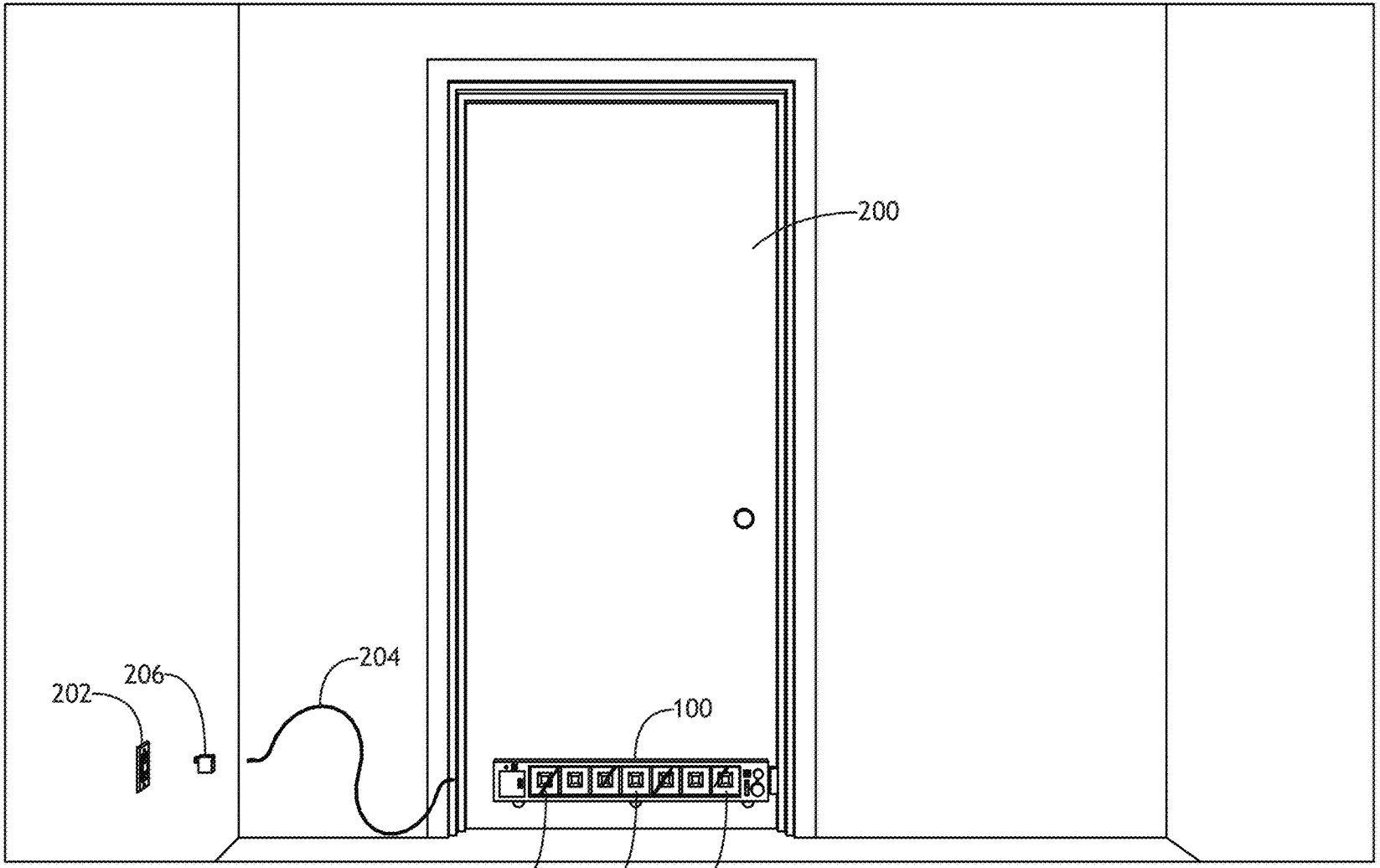
FIG. 2A is a diagram illustrating a lighting apparatus affixed to a door, in accordance with one or more embodiments of the present disclosure.
Figure 2B:
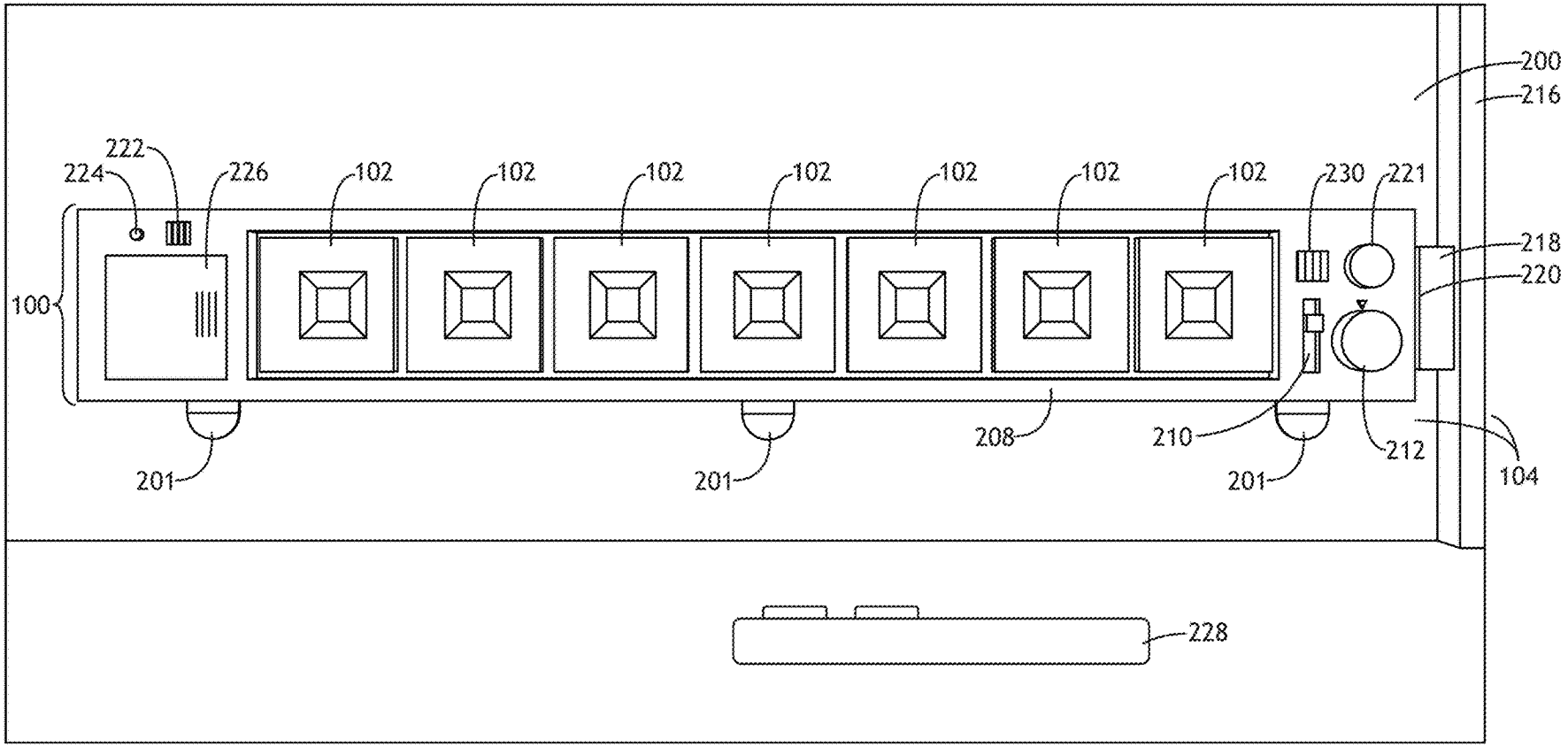
FIG. 2B is a perspective view of a lighting apparatus affixed to a door, in accordance with one or more embodiments of the present disclosure.
Figure 2C:
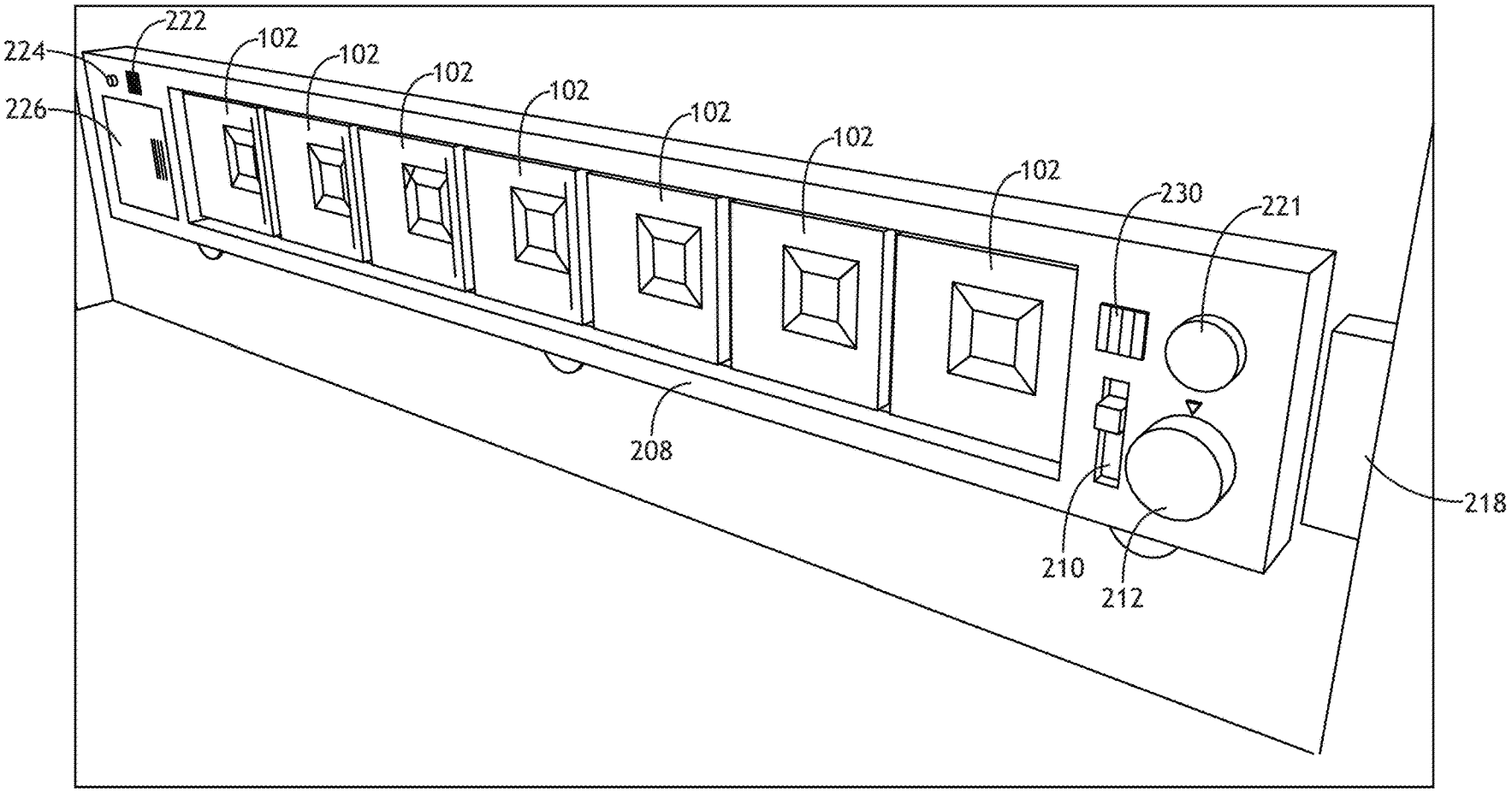
FIG. 2C is a close-up view of a lighting apparatus affixed to a door, in accordance with one or more embodiments of the present disclosure.
Figure 2D:
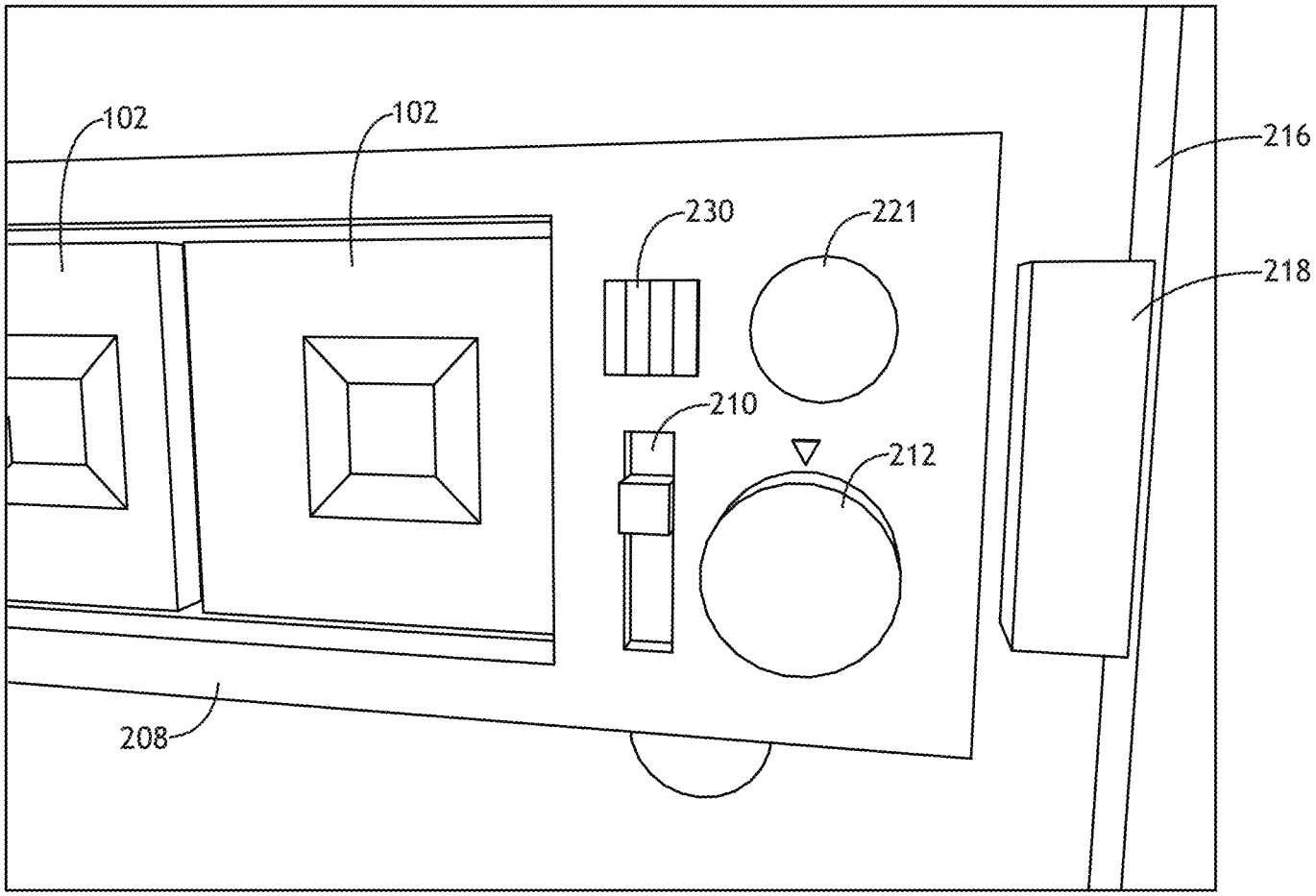
FIG. 2D is a perspective view of a lighting apparatus affixed to an open door, in accordance with one or more embodiments of the present disclosure.
Figure 2E:
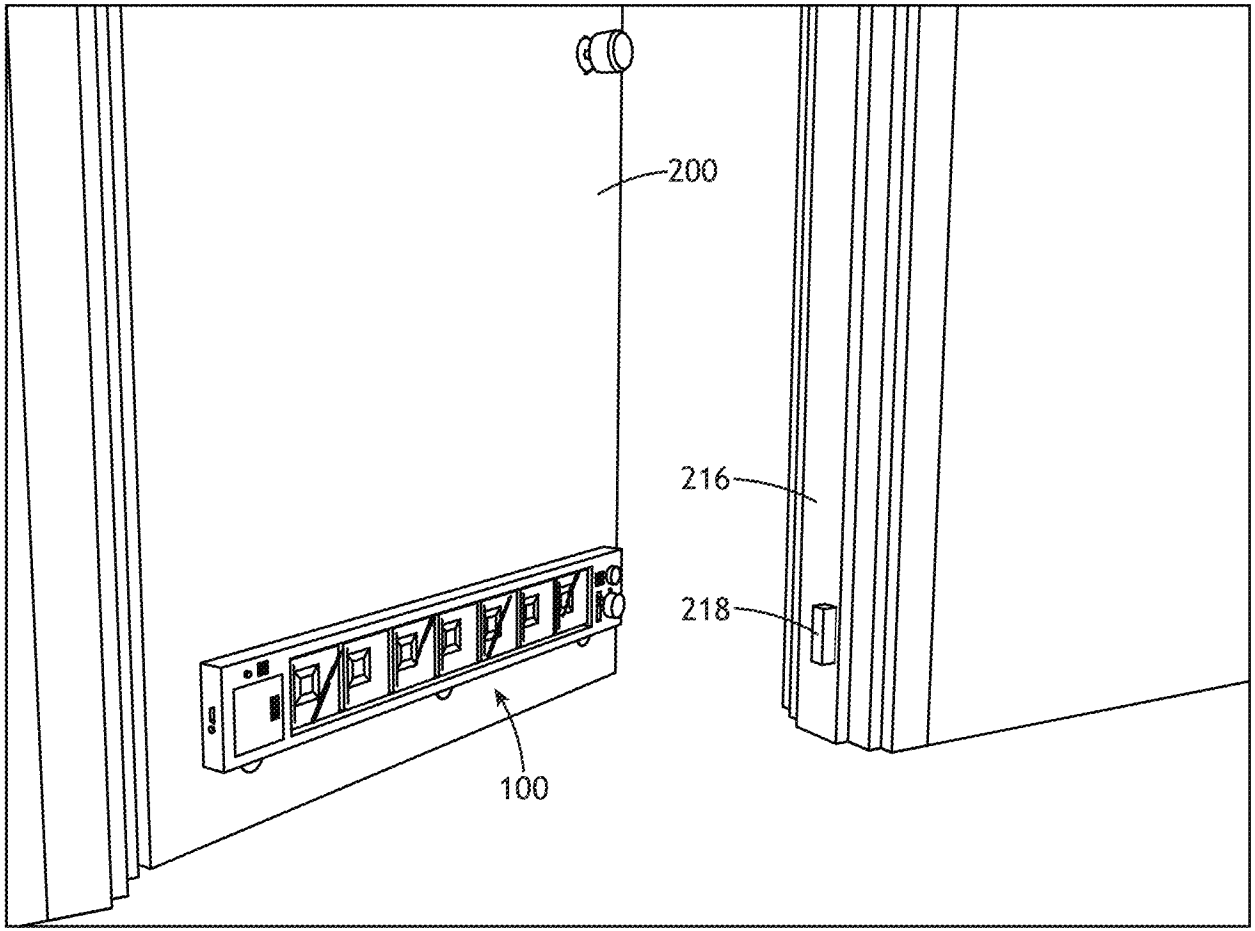
FIG. 2E is a close-up perspective view of a lighting apparatus affixed to a door, in accordance with one or more embodiments of the present disclosure.

FIG. 2A is a diagram illustrating a lighting apparatus 100 affixed to a door 200, in accordance with some embodiments of the present disclosure. The door 200 may be any door 200 used in a residential or commercial building. For example, the door 200 may be a bedroom door in an apartment building. In another example, the door 200 may be a bathroom door in an office building.

The door 200 may be of any type known in the art including a hinged door, a sliding door, a pivot door, a French door, or a folding door. For example, the door 200 may be a hinged door commonly used in bedrooms. The door 200 may be composed of any material known in the art including but not limited to a wood door, a composite wood door, a metal door, a glass door, or a plastic door. For example, the door 200 may be a composite door made of medium density fiberboard (MFD).

In some embodiments, the lighting apparatus 100 includes one or more door attachment elements 201 configured to facilitate the attachment of the lighting apparatus 100 to the door 200. The one or more door attachment elements 201 may include any type of attachment technology. For example, the door attachment element 201 may comprise an adhesive strip. For instance, the door attachment element 201 may comprise Command Brand™ adhesive strips manufactured by the 3M company. In another example, the door attachment element 201 may comprise a magnetic coupler. For instance, the door attachment element 201 may include a magnetized element attached to the lighting apparatus 100 that magnetically couples the lighting apparatus 100 to a metal strip that is affixed to the door 200 or directly to a metal door or metal door element. In another instance, the door attachment element 201 may include a metallic element attached to the lighting apparatus 100 that magnetically couples to a magnetic element affixed to the door 200. In another example, the door attachment element 201 may comprise suction cups (e.g., for a glass or metal door). In another example, the door attachment element 201 may comprise a support for accepting screws or nails.

In some embodiments, the lighting apparatus 100 is powered by an external electrical source, such as an electrical outlet 202. For example, an electrical cord 204 may be coupled to the lighting apparatus 100 on a first end, and coupled to an electrical plug 206 on a second end, with the electrical plug 206 configured to couple to the electrical outlet 202. The electrical cord 204 may be detachable from the lighting apparatus 100 and/or the electrical plug 206. Together, the electrical cord 204 and the electrical plug 206, may power the lighting apparatus 100 to illuminate when the electrical plug 206 is plugged into the electrical outlet 202. In some embodiments, the lighting apparatus 100 includes batteries that are charged by the connection between the electrical outlet 202 and the lighting apparatus 100. In some embodiments, the lighting apparatus 100 is configured to illuminate and charge the batteries at the same time via the connection between the electrical outlet 202 and the lighting apparatus 100.

The electrical plug 206 and electrical cord 204 may be of any type used for powering a device. For example, the electrical plug 206 may be configured as a universal serial device (USB) wall adapter, with the electrical cord configured as a USB cord with USB compatible ends. Any type of USB connector (e.g., USB-A, USB-B, USB-C, Mini-USB, or Micro-USB) may be used. In another example, the electrical plug may be a traditional two- or three-pronged power cord that is wired directly to the lighting apparatus 100. In another example, the electrical plug 206 and electrical cord 204 may be configured as a traditional 5V/1A or 5V/2.1A power supply.

FIGS. 2B through 2E are close-up views of the lighting apparatus 100 affixed to the door 200, in accordance with some embodiments of the present disclosure. In embodiments, the lighting apparatus 100 includes one or more lighting elements 102 housed within a housing 208. The housing 208 may be disposed on any surface of the door. For example, the housing 208 may be configured to an end portion of the door. For instance, the housing 208 may be configured to conform to the lower end portion of the door, adjacent to the threshold.

The lighting apparatus 100 may have any number of lighting elements 102 in any configuration. For example, the lighting apparatus 100 may be configured as seven lighting elements 102 linearly arranged (e.g., as in FIG. 2). In another example, the lighting apparatus 100 may be configured as a single lighting element 102. In another example, the lighting apparatus 100 may be configured to have one-hundred lighting elements 102 arranged on the perimeter of the housing 208.

The one or more lighting elements 102 may be of any type of lighting element 102 known in the art including but not limited to a fluorescent light element, an incandescent light element, a halogen bulb, or a light emitting diode (LED). For example, the lighting element 102 may be a miniature LED. In another example, the lighting element 102 may be a compact fluorescent (CFL) bulb.

The one or more lighting elements 102 may emit any type or color of light (i.e., any light wavelength). For example, the one or more lighting elements 102 may emit a white light. In another example, the one or more lighting elements 102 emit a blue light. The one or more lighting elements may be configured to emit more than one color of light. For example, the one more lighting elements 102 may switch between white, blue, and red light. For instance, the lighting elements 102 may switch colors automatically (e.g., every five minutes). In another example, the colors may be switched manually.

In some embodiments, the user interface 112 includes a control switch 210 communicatively coupled to the controller 106. The control switch 210 is configured to control, via the controller 106, the lighting apparatus 100 and/or the lighting element 102. The control switch 210 may be configured to change between several operational states of the lighting apparatus 100. For example, the control switch 210 may be configured to switch the lighting apparatus 100 from an inactive to an active state (i.e., the active state distinguished by the ability of the lighting apparatus to detect a door closure and turn on the one or more lighting elements 102 upon door-closure detection). For instance, when the lighting apparatus 100 is in an active state, lighting element 102 may be configured to emit light for a defined duration when the door is closed, whereas when the lighting apparatus 100 is in the inactive state, the lighting element 102 does not emit light. One or more control switches 210 may be used to configure the operational settings for the lighting apparatus 100.

In some embodiments, the user interface 112 includes a lighting choice switch 212 communicatively coupled to the controller. The lighting choice switch 212 is configured, via the controller 106, to change the intensity, emitted color, and/or the lighting changing sequence of the one or more lighting elements 102. For example, the lighting choice switch 212 may be configured to select a change in the color emitted from the one or more lighting elements 102 from white light to blue light. In another example, the lighting choice switch 212 may be configured to select a change in the pattern or rate of color switching by the lighting apparatus 100. For instance, the lighting choice switch 212 may be configured to select a change of a color pattern from a continuous white light (e.g., no color switching) to a pattern where the one or more lighting elements 102 repeatedly switches from white to blue (e.g., every 30 seconds). In another instance, the lighting choice switch 212 may be configured to select a strobe effect (e.g., flashing ability), where the one or more lighting elements 102 flash on and off in a pattern. In another example, the lighting choice switch 212 may be configured to select a light of a specific intensity (e.g., a lower intensity to prevent the light from awaking a user). The lighting choice switch 212 may be any type of switch known including but not limited to a knob, a sliding switch, or a toggle. In another example, the lighting choice switch 212 may be combined with the control switch 210 (i.e., the functions of the lighting choice switch 212 and the control switch 210 may be combined onto a single switch, knob, or toggle). In another example, the lighting apparatus 100 may include multiple lighting choice switches 212. For instance, the lighting apparatus may include two lighting choice switches 212: one lighting choice switch 212 for selecting a light color, and one light choice switch 212 for selecting a strobe effect. Many possible combinations of switches and the control of a light characteristic by a switch are possible. Therefore, the above description should not be interpreted as a limitation of the present disclosure, but merely as an illustration.

In some embodiments, the lighting apparatus 100 includes an ambient light sensor communicatively coupled to the controller 106 configured to determine the ambient light level within the room facing the door 200 (e.g., to detect sunlight and/or light from another lamp). For example, the lighting apparatus may be configured, via the controller, to turn off the one or more lighting elements 102 if the ambient light sensor detects light (e.g., daylight and/or lamp light). The ambient light sensor may include any light sensing technology known including but not limited to a photoresistor, a photodiode, or a phototransistor. For example, the ambient light sensor may include a photoresistor and be configured to turn on the lighting apparatus when ambient light levels fall below a predetermined threshold.

In some embodiments, the lighting apparatus 100 includes a timing mechanism commutatively coupled to the controller configured to sense the door position and/or activate the lighting apparatus at a predetermined time of day (e.g., to sense the door position and/or activate the lighting element 102 only at bedtime). The timing mechanism may be configured by a user. For example, a lighting apparatus 100 may be configured to actively sense the door position from 9 p.m. to 7 a.m. (i.e., during a child's bedtime). In another example, the timing mechanism may be configured, via the controller 106, to activate a setting wherein the lighting element is operational only during nighttime. The timing mechanism may be set using a user interface device, such as a knob, a switch, or a keypad.

In some embodiments, the lighting apparatus 100 is configured to deactivate the lighting elements after a predetermined period of time, as selected by the control switch 210. The lighting apparatus 100 may be configured to be set for any time interval and/or number of time intervals. For example, the lighting apparatus 100 may be configured to emit light for 15 minutes, 30 minutes, and/or 60 minutes after the lighting apparatus 100 has sensed that the door 200 has closed. In another example, the lighting apparatus may be configured to emit light for 10 minutes after the lighting apparatus has sensed that the door 200 has closed. The lighting apparatus may also be configured to be set for continuous light (e.g., with no time restriction).

In some embodiments, the lighting apparatus 100 further includes a door position sensor 104 communicatively coupled to the controller 106 that can detect a position of the door 200 in relation to a door frame 216. For example, the door position sensor 104 may detect when the door 200 is in, or is moved to, the open position. In another example, the door position sensor 104 may detect when the door 200 is in, or is moved to, the closed position. In some embodiments, the door position sensor 104 may be configured as two components. For example, the door position sensor 104 may include a stationary position marker 218 that attaches to the frame 216 of the door 200. The door position sensor 104 may include an internal sensor component 220 that is housed, or partially housed, within the housing 208. In some embodiments, the door position sensor 104 is configured as one component housed entirely within the housing 208.

The stationary position marker 218 may be attached to any surface of the door frame 216 that allows the door position sensor 104 to detect the position of the door 200. For example, for a hinged door 200, the stationary position marker 218 may be attached to the frame side opposite of the jamb (e.g., as shown in FIG. 2). In another example, the stationary position marker 218 may be attached to the threshold (e.g., saddle, sill, or floor). In another example, the stationary position marker 218 may be attached to the top frame side (e.g., the frame or casing above the door). In another example, the stationary position marker 218 may be attached to the jamb. It should be understood that a lighting apparatus 100 having a door position sensor 104 configured as one component housed entirely within the housing 208 may also utilize any side of the frame 216 for detecting the position of the door 200. Therefore, the above description should not be interpreted as a limitation of the present disclosure, but merely as an illustration.

In some embodiments, the door position sensor 104 includes a mechanical trigger device configured to sense when the door 200 is in the open and/or closed position. Any type of mechanical triggering device may be used for this purpose. For example, the mechanical triggering device may be a raised surface on the stationary position marker 218 that makes contact with the internal sensor component 220. For instance, the stationary position marker 218 may actuate a switch within the internal sensor component 220, indicating to the lighting apparatus 100 that the door 200 is closed.

In some embodiments, the door position sensor 104 comprises a transducer such as a light sensor (e.g., optical sensor) configured to sense when the door is in an open and/or closed position. For example, the door position sensor 104 may include a light source disposed on either the stationary position marker 218 or the internal sensor component 220 and a light detecting element disposed on either the stationary position marker 218 or the internal sensor component 220. For instance, the stationary position marker 218 may include a light source that emits a light in the direction of the stationary position marker 218 when the door is closed. The stationary position marker 218 may include a reflective element (e.g. a mirror) that reflects light coming from the light source back to a light detecting element disposed on the internal sensor component. This arrangement allows both the light source and the light detection element to be integrated with control circuitry 108 contained within the housing 208. The light emitted by the light source of the door position sensor 104 may be any type of electromagnetic energy. For example, the emitted light may be visible light. In another example, the emitted light may be infrared light. Any light source device may be used for the door position sensor 104 including but not limited to a light emitting diode (LED), an incandescent light, a fluorescent light, or a laser. For example, the light source may include an infrared LED. The light detecting element used for the light sensor may be any light detecting element known in the art including but not limited to a photoresistor, a photodiode, or a phototransistor. For example, the light sensor may include a photoresistor configured as a cadmium sulfide light-dependent resistor.

In some embodiments, the door position sensor 104 comprises a magnetic sensor configured to sense when the door is in an open and/or closed position. For example, the door position sensor 104 may include a magnetic sensor disposed within the internal sensor component 220 and a magnetic and/or metallic component disposed on the stationary position marker 218 (i.e., the magnetic sensor is tripped when coming into near-proximity of the magnetic and/or metallic component). The magnetic sensor may include any type of magnetic sensor including but not limited to a reed switch, an inductive magnetic sensor, a variable reluctance magnetic sensor, a magneto resistive sensor, or a hall effect sensor. For example, the magnetic sensor may be configured as a normally open (NO) reed switch.

In some embodiments, the door position sensor 104 comprises radio frequency identification (RFID) technology. For example, the stationary position marker 218 may include a passive RFID tag, with the internal sensor component 220 including a RFID reader device. For instance, the passive RFID tag and RFID reader device may be configured so that when the two components are in close proximity (e.g., when the door is closed) the RFID reader device detects the passive RFID, and sends a signal to the controller 106 indicating that the door 200 is closed.

In some embodiments, the lighting apparatus 100 includes a motion sensor 221 communicatively coupled to the controller 106 configured to detect movement within the room facing the door 200. The motion sensor 221 may use any technology known including but not limited to passive infrared-based sensors, microwave-based sensors, ultrasonic-based sensors, and the like. For example, the motion sensor 221 may include as a microwave-based motion sensor configured to activate, via the controller 106, one or more lighting elements 102, upon detecting movement (e.g., to assist a child in finding the door 200 in a dark room).

As noted previously herein, the controller 106 may include control circuitry 108 and memory 110. The memory 110 may include program instructions configured to cause the control circuitry 108 to carry out various steps of the present disclosure. In some embodiments, the program instructions are configured to cause the control circuitry 108 to adjust one or more characteristics of the lighting element 102 (e.g., intensity, ON/OFF status) after detecting the positional status of the door 200.

The memory 110 can be an example of tangible, computer-readable storage medium that provides storage functionality to store various data and/or program code associated with operation of the lighting apparatus 100. Thus, the memory 110 can store data, such as a program of instructions for operating the controller 106 and other components of the lighting apparatus 100. The memory 110 can be integral with the controller 106, can comprise stand-alone memory, or can be a combination of both. Some examples of the memory 110 can include removable and non-removable memory components, such as random-access memory (RAM), read-only memory (ROM), flash memory (e.g., a secure digital (SD) memory card, a mini-SD memory card, and/or a micro-SD memory card), solid-state drive (SSD) memory, magnetic memory, optical memory, universal serial bus (USB) memory devices, hard disk memory, external memory, and so forth.

The control circuitry 108 may include any type of electronic circuit or processor that may separately or collectively perform the functions and/or steps as described herein. For example, the control circuitry may include circuits disposed on a printed circuit board (PCB) or a printed wiring board (PWB). The control circuitry may also include processing elements, including but not limited to integrated circuits (e.g., application specific integrated circuits (ASIC) and field programmable gate arrays (FPGA). The controller 106 is not limited by the materials from which it is formed or the processing mechanisms employed therein and, as such, can be implemented via semiconductor(s) and/or transistors (e.g., using electronic integrated circuit (IC) components), and so forth.

In some embodiments, the lighting apparatus 100 includes a smoke alarm configured to warn an occupant of the room of the presence of smoke. The smoke alarm may be enclosed within the housing 208. Smoke may enter the housing through a smoke intake window 222, where the smoke may then be detected by the smoke alarm. The smoke intake window 22 may also provide an opening for a speaker of the smoke alarm, allowing sound from the smoke alarm to exit the housing 208. The lighting apparatus 102 may also include a smoke test button 224 configured to allow a user to test whether the smoke alarm is operational. The smoke alarm may be communicatively coupled to the controller, wherein the one or more lighting elements 102 may be configured to light in response to the smoke alarm. For example, upon the detection of smoke, the smoke alarm may sound and cause the one or more lighting elements 102 to flash.

In some embodiments, the lighting apparatus 100 includes a battery housing 226 (e.g., obscured by a battery housing lid) configured to house one or more batteries that may power the lighting apparatus 100. For example, the one or more batteries within the battery housing 226 may be configured as the main power supply for the lighting apparatus 100. In another example, the one or more batteries within the battery housing 226 may be configured as a backup power supply for the lighting apparatus 100.

In some embodiments, the user interface 112 includes a remote-control device 228 configured to control one or more functions of the lighting apparatus 100. For example, the remote-control device 228 may be configured to activate and/or deactivate the lighting apparatus 100. In another example, the remote-control device 228 may be configured to activate and/or deactivate the door position sensor 104. In another example, the remote-control device 228 may be configured to active the lighting element 102 for a predetermined amount of time. For instance, the remote-control device 228 may be configured to reset the timing mechanism for the lighting element. Many different functions of the remote-control device are possible. Therefore, the above description should not be interpreted as a limitation of the present disclosure, but merely as an illustration.

The remote-control device 228 may be configured as any type of remote-control device known including but not limited to infrared (IF) remote-control or a radio frequency (RF) remote-control. For example, the remote-control device 228 may be an IF remote-control that includes an infrared light emitting diode (LED). The signal from the remote-control device 228 may be received by a remote signal receiver 230.

In some embodiments, the remote-control device 228 is configured as a personal mobile device (e.g., tablet, phone, phablet, or laptop computer). For example, the remote-control device 228 may be configured as a mobile phone. For instance, the mobile phone may be configured to communicate with the lighting apparatus 100 via Bluetooth, or other communication signal. An application (app) on the mobile phone may then be used to control one or more settings of the lighting apparatus 100.

The remote-control device 228 may also notify a user of the status of the lighting apparatus 100. For example, an app on the remote-control device 228 may be configured to emit a sound, vibrate, or display a warning when the door position sensor 104 has determined that the door is open. In another example, an app on the remote-control device 228 may be configured to emit a sound, vibrate or display a warning when the motion sensor 221 has detected motion. In another example, an app on the remote-control device 228 may be configured to emit a sound, vibrate or display a warning when the microphone has detected an acoustic alarm. The 2-way communication between the remote-control device 228 and the lighting apparatus 100 may be implemented in many different configurations. Therefore, the above description should not be interpreted as a limitation of the present disclosure, but merely as an illustration.

In some embodiments, the control circuitry includes communication circuitry configured to establish a network communication connection between the controller 106 and a user communication device (e.g., the remote-control device 228 or personal remote device). Any type of network communication technology, network protocol, or network signal may be used to facilitate communication between the control circuitry 108 and the user communication device including but not limited to Bluetooth, BLW, ZibBee, Z-Wave, 6LoWPAN, Thread, NB-IoT, 5G, NFC, RFID, SigFox, LoRaWAN, and Weightless-N. For instance, a tablet may be configured to initiate a change (e.g., through an app) of a setting on the lighting apparatus 100 via a 5G network communication link between the tablet and the lighting apparatus 100.

In some embodiments, the lighting apparatus 100 further includes a voice-activated control device communicatively coupled to the controller 106. For example, the voice-activated control device may be configured to turn the lighting element 102 when the voice command "Turn on" is given. In another example, the voice-activated control device may be configured to reset the time that the lighting element 102 is set to turn off when the voice command "Reset timer" is given. Any voice command may be used to change, activate, and disable any operating characteristic of the lighting apparatus 100. Therefore, the above description should not be interpreted as a limitation of the present disclosure, but merely as an illustration.

Figure 2F:
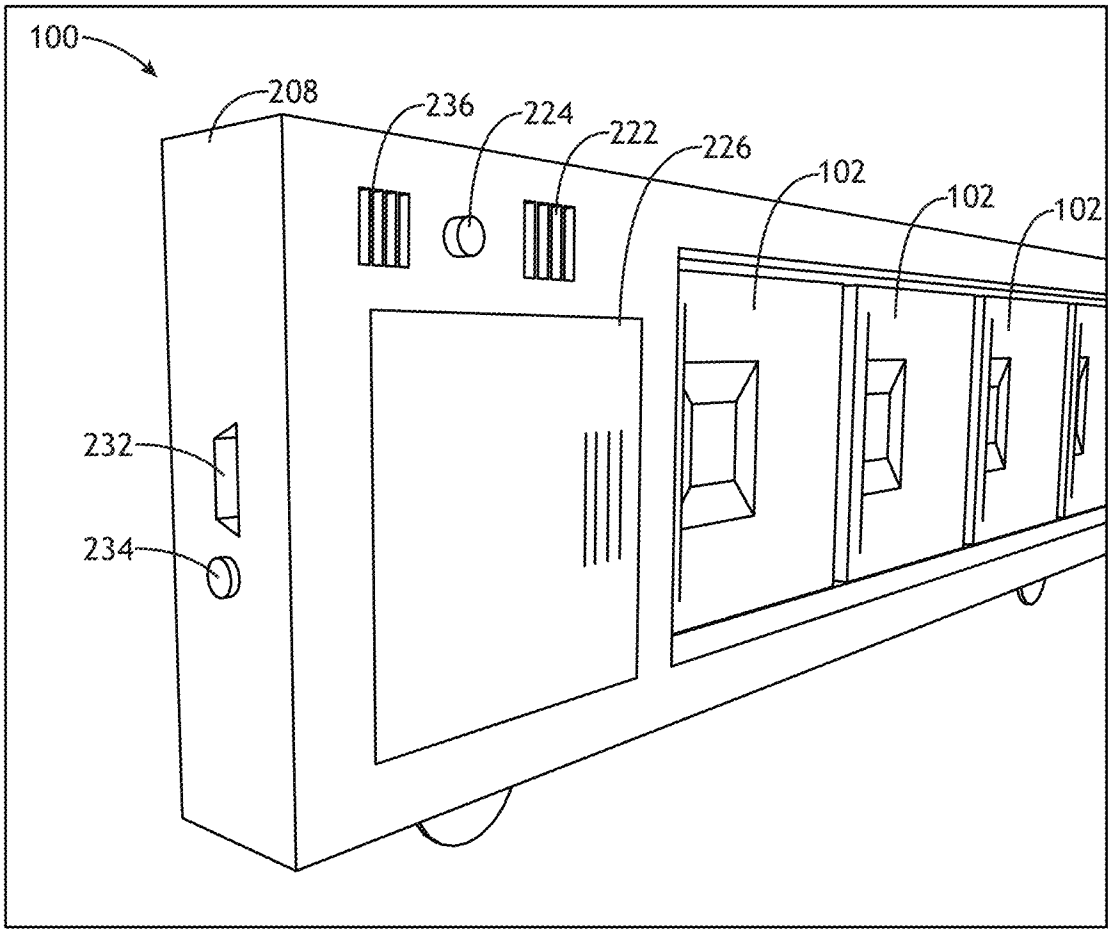
FIG. 2F illustrates a perspective close-up view of the lighting apparatus, in accordance with one or more embodiments of the disclosure.

FIG. 2F illustrates a perspective close-up view of the lighting apparatus 100, in accordance with one or more embodiments of the disclosure. In embodiments, the lighting apparatus 100 includes a charging port 232 configured to receive the end of the electrical cord 204. The lighting apparatus 100 further includes a charge indicator 234 configured to emit a signal indicating the battery/charged status of the lighting apparatus. For example, if the batteries are well charged, the charge indicator 234 may be configured to emit a green light (e.g., from an LED). In another example, if the batteries are not effectively charged, the charge indicator 234 may be configured to emit a red light.

In some embodiments, the lighting apparatus 100 includes an aperture 236 for the speaker 114 and/or microphone. For example, the speaker 114 may play a lullaby, with the sound of the lullaby propagating through the aperture 236. In another example, sound of the smoke alarm may propagate through the aperture. In another example, a voice command from the user may propagate through the aperture to the microphone. In another example, the propagate sound of an alarm may propagate through the aperture to the microphone. For instance, the microphone, upon picking up the sound of a smoke alarm, may activate the lighting element 102 via the controller 106.

Figure 3:
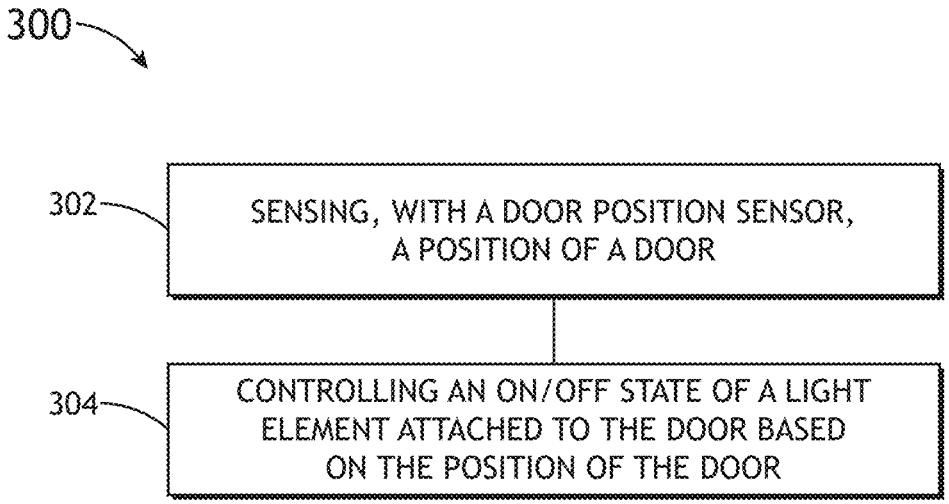
FIG. 3 is a flow chart illustrating a method for controlling a lighting apparatus, in accordance with one or more embodiments of the disclosure.

FIG. 3 is a flow chart illustrating a method 300 for controlling the lighting apparatus 100, in accordance with one or more embodiments of the disclosure. In some embodiments, the method 300 includes a step 302 of sensing, with a door position sensor 104, a position of a door 200. For example, the door position sensor 104 may a light sensor as described herein.

In some embodiments, the method 300 includes a step 304 of controlling an ON/OFF state of a light element 102 attached to the door 200 based on the position of the door 200. For example, the control circuitry 108 may be configured to switch the lighting element from an OFF state to an ON state when the door is moved to a closed position. In another example, the control circuitry 108 may be configured to switch the lighting element from an ON state to an OFF state when the door is moved to an open position.

Figure 4:
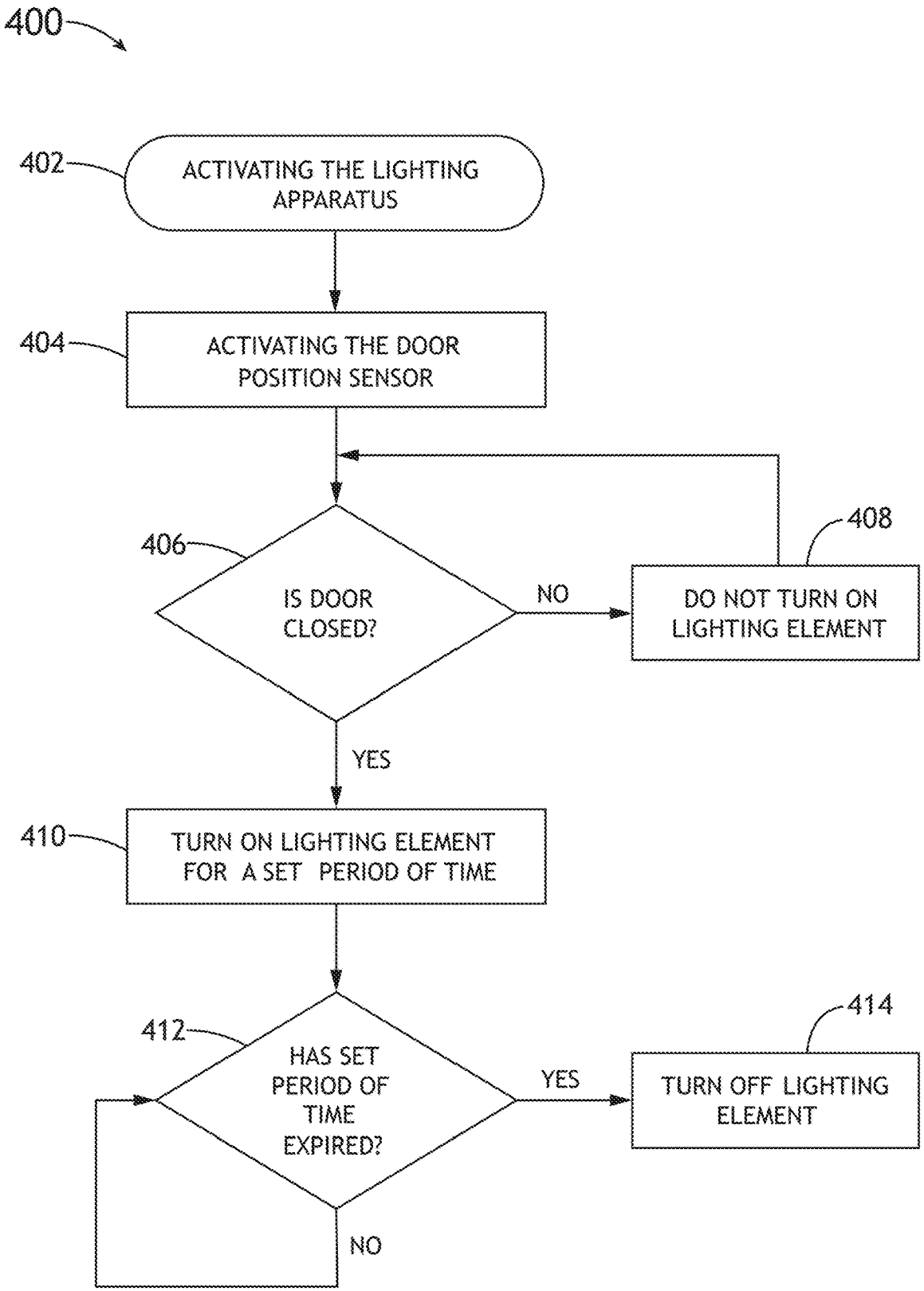
FIG. 4 is a flow chart illustrating a method 400 for controlling a lighting apparatus 100, in accordance with one or more embodiments of the disclosure.

FIG. 4 is a flow chart illustrating a method 400 for controlling a lighting apparatus 100, in accordance with one or more embodiments of the disclosure. The method 400 may incorporate one or more steps from one or more methods described herein. In some embodiments, the method 400 includes a step 402 of activating the lighting apparatus 100. Activating one the lighting apparatus 100 may include manually operating a switch on the housing 208 of the lighting apparatus 100 (e.g., the control switch 210 and/or the lighting choice switch 212), operating the remote-control device 228, and/or plugging the electrical plug 206 into the electrical outlet 202.

In some embodiments, the method 400 includes a step 404 of activating the door position sensor 104. For example, the lighting apparatus 100 may be configured to activate the door position sensor 104 automatically when the lighting apparatus 100 is switched on. In another example, the door position sensor 104 may be activated by manual operation of the control switch 210 or the remote-control device 228.

In some embodiments, the method 400 includes a step 406 of sensing if the door is closed, via the door position sensor 104. For example, if the door position sensor 104 determines that the door is not closed (e.g., in the open position), the method may proceed to a step 408 of not turning on the lighting element 102. The method may then repeat the step 406 as the door position sensor 104 continuously monitors the position of the door 200. If the door position sensor 104 senses that the door is in the closed position, the method 400 may proceed to a step 410 of turning on the lighting element 102 for a set period of time. The set period of time may include any time designated by the lighting apparatus 100. For example, the set period of time may be 15 minutes. In another example, the set period of time may be one hour.

In some embodiments, the method 400 includes a step 412 of determining if the set period of time has expired, For example, a timing circuit within the control circuitry 108 may monitor an elapsed time that the lighting element 102 has been turned on and compare the this amount of time to the designated set period of time. For instance, if the control circuitry 108 has determined that the lighting element 102 has not been on for the set period of time, the lighting element will remain on, and the control circuitry 108 will continue to monitor the elapsed time that the lighting element 102 has been turned on. In another instance, if the control circuitry 108 has determined that the set period of time has expired, the method 400 may proceed to a step 414 of turning off the lighting element 102.

Figure 5:
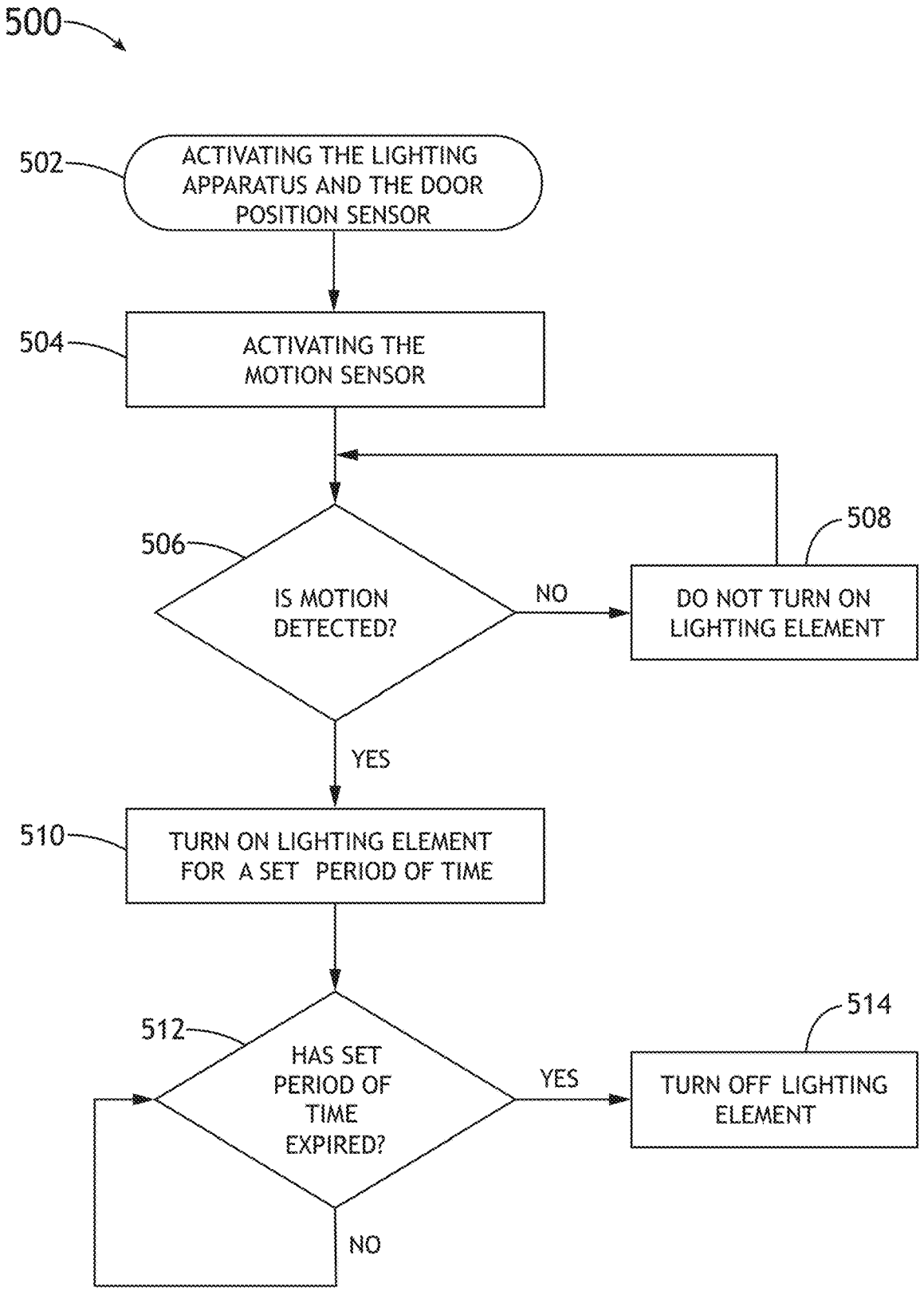
FIG. 5 is a flow chart illustrating a method 500 for controlling a lighting apparatus 100, in accordance with one or more embodiments of the disclosure.

FIG. 5 is a flow chart illustrating a method 500 for controlling a lighting apparatus 100 comprising the motion sensor 221, in accordance with one or more embodiments of this disclosure. The method 500 may include one or more steps from one or more methods 300, 400 described herein. In the method 500, the motion sensor 221 detects motion proximate to the lighting apparatus 102. The motion sensor 221 may be set to detect motion from any range. For example, the motion sensor 221 may detect motion from one centimeter from the motion sensor 221 (e.g., essentially in front of the motion sensor 221) to one meter from the motion sensor 221. In another example, the motion sensor may detect motion up to three meters from the motion sensor 221. Once motion has been detected by the motion sensor 221, the lighting element 102 may be turned on for a short length of time to assist the user.

In embodiments, the method 500 includes a step 502 of activating the lighting apparatus 102 and the door position sensor 221. For example, activating the lighting apparatus 102 and the door position sensor 221 may include actions and/or procedures described in method 400. In this method 500, the door is in the closed position and the set period of time has expired for keeping the lighting element 102 (e.g., the status of the lighting apparatus 100 at the step 414 of the method 400).

In embodiments, the method 500 includes a step 504 of activating the motion sensor 221. For example, the lighting apparatus 100 may be configured to activate the motion sensor 221 automatically when the lighting apparatus 100 is switched on. In another example, the motion sensor 221 may be activated by manual operation of the control switch 210 or by the remote-control device 228.

In embodiments, the method 500 includes the step 506 of determining if motion is detected via the motion sensor 221. For example, if motion is not detected by the motion sensor 221, the method 500 will proceed to a step 508 of not turning on the lighting element 102. The method 500 may then repeat the step 506 as the motion sensor 221 continuously monitors the area adjacent to the lighting apparatus 100 for motion. If motion is detected by the motion sensor 221, the method 500 may proceed to a step 510 of turning on the lighting element 102 for a set period of time. The set period of time may include any time designated by the lighting apparatus 100. For example, the set period of time may be 30 seconds. In another example, the set period of time may be five minutes.

In some embodiments, the method 500 includes a step 512 of determining if the set time has expired. This step utilized the timing circuit in conjunction with the control circuitry 108 as described herein. For example, if the control circuitry 108 has determined that the lighting element 102 has not been on for the set period of time, the lighting element will remain on, and the control circuitry 108 will continue to monitor the elapsed time that the lighting element 102 has been turned on. In another instance, if the control circuitry 108 has determined that the set period of time has expired, the method 400 may proceed to a step 514 of turning off the lighting element 102.

Figure 6:
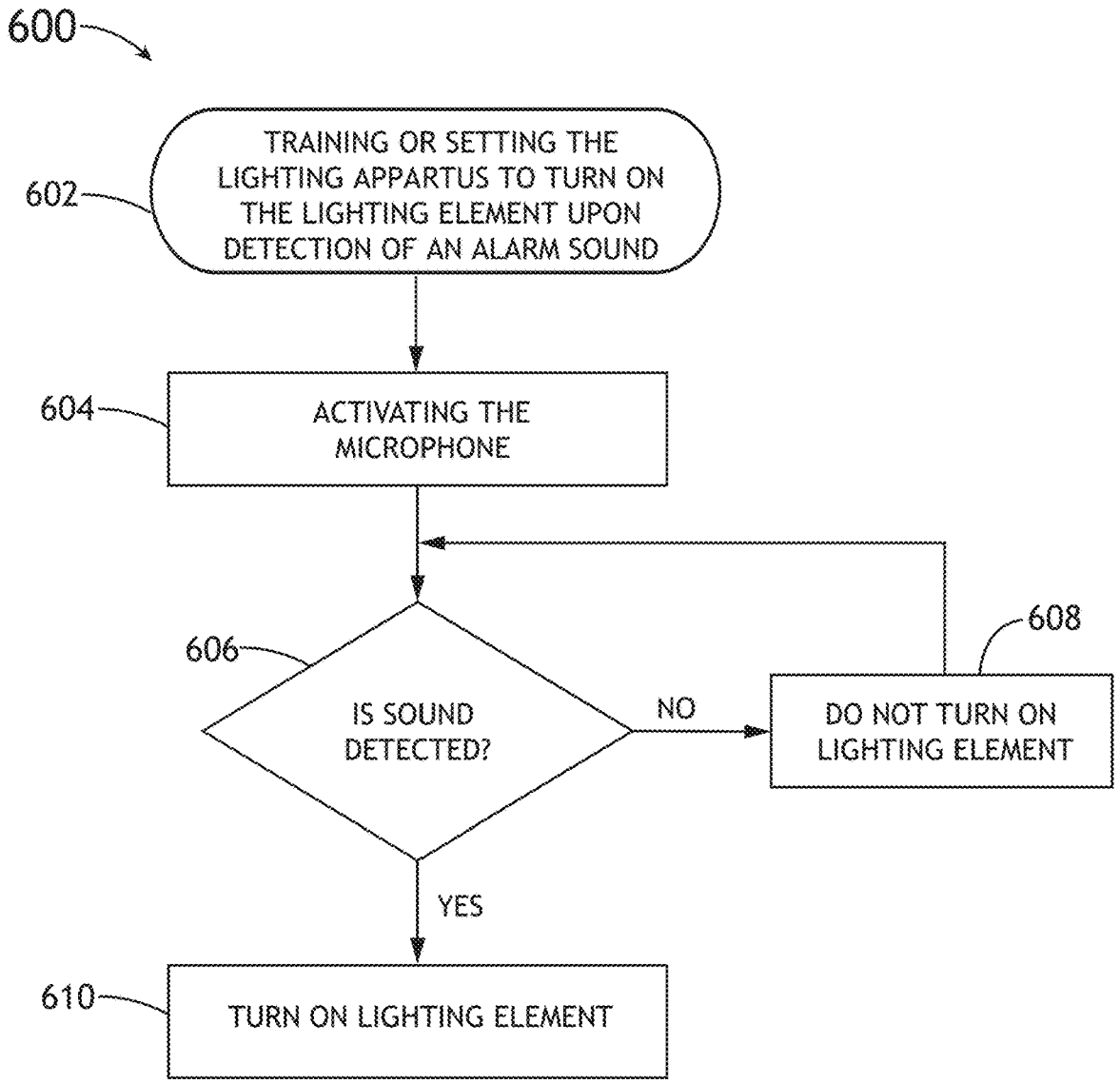
FIG. 6 is a flow chart illustrating a method 600 for controlling a lighting apparatus 100 in accordance with one or more embodiments of the disclosure.

FIG. 6 is a flow chart illustrating a method 600 for controlling a lighting apparatus 100 configured to detect an acoustic alarm, in accordance with one or more embodiments of the disclosure. The method 600 may include one or more steps from one or more methods 300, 400, 500 described herein. In some embodiments, the lighting apparatus 100 is configured to turn on the lighting element 102 upon the detection of a specific sound. For example, the lighting apparatus 100 may turn on the lighting element 102 when a high-pitched sound is detected by a microphone within the lighting apparatus 100. For instance, an external smoke alarm may emit a sound that the lighting apparatus 100 is able to detect and recognize as an alarm, causing the lighting apparatus 100 to turn on the lighting element. In another example, the sound of broken glass may be detected be detected by the lighting apparatus 100, causing the lighting apparatus 100 to turn on the lighting element 102.

In some embodiments, the method includes a step 602 of training or setting the lighting apparatus 100 to turn on the lighting element 102 upon detection of an alarm sound. For example, the user may cause an external smoke alarm to sound via pressing a test button, while the lighting apparatus 100 in in a learning mode (e.g., the microphone within the lighting apparatus 100 picking up the alarm sound), causing the lighting apparatus 100 to recognize the alarm sound and to turn on the lighting element 102 when the alarm sounds. In another example, the lighting apparatus 100 may be switched to a setting where the lighting apparatus 100 will turn on the lighting element 102 when the lighting apparatus 100 detects the sound of broken glass via the microphone.

In embodiments, the method includes a step 604 of activating the microphone. For example, the lighting apparatus 100 may be configured to activate the microphone automatically when the lighting apparatus 100 is switched on. In another example, the microphone may be activated by manual operation of the control switch 210 or by the remote-control device 228. In a lighting apparatus with voice control, activation of the microphone may cause a switching of the microphone and related circuitry from only detecting voice sounds to detection of voice sounds and alarm sounds.

In embodiments, the method 600 includes a step 606 of determining if an alarm sound is detected via the microphone. For example, if an alarm sound is not detected by the microphone, the method 600 will proceed to a step 608 of not turning on the lighting element 102. The method 600 may then repeat the step 506 as the microphone continuously monitors the area for alarm sounds. If the alarm sound is detected by the microphone, the method 600 may proceed to a step 610 of turning on the lighting element 102.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

The previous description is presented to enable one of ordinary skill in the art to make and use the invention as provided in the context of a particular application and its requirements. Various modifications to the described embodiments will be apparent to those with skill in the art, and the general principles defined herein may be applied to other embodiments. Additionally, phrases that disclose the addition of one component to another component are not limiting to the sequence or placement of one component to another component. For example, the addition of component A to component B may have the same meaning as the addition of component B to component A (e.g., the two components are mixed together). Therefore, the present invention is not intended to be limited to the particular embodiments shown and described, but is to be accorded the widest scope consistent with the principles and novel features herein disclosed.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

It is further contemplated that each of the embodiments of the method described above may include any other step(s) of any other method(s) described herein. In addition, each of the embodiments of the method described above may be performed by any of the systems described herein.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

What is claimed:

1. A lighting apparatus fixable to a door comprising:

an illumination assembly comprising:

a lighting element configured as a night light;

a door position sensor;

a control circuit communicatively coupled to the lighting element and the door position sensor, wherein the control circuit is configured to control an ON/OFF state of the lighting element based on one or more signals from the door position sensor, wherein the control circuit is configured to switch the lighting element from an OFF state to an ON state when the door is moved to a closed position, wherein the control circuit is configured to switch the lighting element from the ON state to the OFF state when the door is moved to an open position; and a housing configured to house the lighting element and the control circuit, wherein the housing is configured to be mechanically attachable to the door, wherein the housing runs alongside a length of an interior side of the door.

2. The lighting apparatus of claim 1, wherein the door position sensor comprises a light sensor configured to sense when the door is in the closed position.

3. The lighting apparatus of claim 1, wherein the door position sensor comprises a transducer configured to sense when the door is in the closed position.

4. The lighting apparatus of claim 1, wherein the door position sensor comprises a mechanical trigger device configured to sense when the door is in the closed position.

5. The lighting apparatus of claim 1, further comprising a stationary position marker, wherein the door position sensor is configured to sense the stationary position marker.

6. The lighting apparatus of claim 5, wherein the stationary position marker is disposed on at least one of a frame of the door or a floor.

7. The lighting apparatus of claim 5, wherein the door position sensor comprises a magnetic sensor and the position marker comprises a magnet, wherein the magnetic sensor is configured to sense the magnet affixed to at least one of a frame of the door or the floor when the door is in the closed position.

8. The lighting apparatus of claim 1, further comprising a voice-activated control device communicatively coupled to the control circuit.

9. The lighting apparatus of claim 1, further comprising a remote-control device communicatively coupled to the control circuit.

10. The lighting apparatus of claim 1, wherein the control circuit comprises communication circuitry configured to establish a network connection between the control circuit and a user communication device.

11. The lighting apparatus of claim 1, further comprising a manual control switch configured to control the illumination assembly.

12. The lighting apparatus of claim 1, further comprising one or more batteries.

13. The lighting apparatus or claim 1, wherein the illumination assembly is powered by an external electrical source.

14. The lighting apparatus of claim 1, wherein the lighting element comprises one or more light emitting diodes (LED).

15. The lighting apparatus of claim 1, wherein the control circuit is configured to deactivate the lighting element after a predetermined period of time.

16. The lighting apparatus of claim 1, wherein the control circuit is configured to deactivate the lighting element during a predetermined time of day.

17. The lighting apparatus of claim 1, wherein the housing is configured to conform to an end portion of the door.

18. The lighting apparatus of claim 1, wherein the housing is configured to attach to the door via an adhesive strip coupled to the door.

19. The lighting apparatus of claim 1, wherein the housing is configured to attach to the door via a magnetic coupler.

20. The lighting apparatus of claim 1, wherein the housing is configured to attach to the door via one or more screws.

21. The lighting apparatus of claim 1, further comprising a speaker.

22. A method for operating a night light configured to attach to an interior of a door comprising:

sensing, with a door position sensor, a position of the door; and controlling an ON/OFF state of a light element attached to the door based on the position of the door, wherein the light element is configured to switch from an OFF state to an ON state when the door is moved to a closed position, wherein the light element is configured to switch from the ON state to the OFF state when the door is moved to an open position.

* * * * *